United States Patent [19]

Gmeiner et al.

[11] Patent Number: 4,652,768

[45] Date of Patent: Mar. 24, 1987

[54] REAR DOOR SAFETY LOCK ARRANGEMENT

[75] Inventors: Guenter Gmeiner; Rudolf Andres, both of Sindelfingen; Holger Seel, Aidlingen, all of Fed. Rep. of Germany

[73] Assignee: Daimler-Benz Aktiengesellschaft, Fed. Rep. of Germany

[21] Appl. No.: 751,043

[22] Filed: Jul. 2, 1985

[30] Foreign Application Priority Data

Jul. 7, 1984 [DE] Fed. Rep. of Germany ..... 3425108

[51] Int. Cl.[4] ..... E05B 65/36

[52] U.S. Cl. ..... 307/10 R; 307/10 AT; 70/264; 70/279; 361/160; 180/281

[58] Field of Search ..... 307/10 R, 10 AT; 70/101, 237, 239, 264, 266, 271, 275, 277, 279, 281, 280, 282, 434, 361, 340; 200/61.64, 42 R, 51.17, 52 R, 52 A, 61.27; 361/160; 180/281

[56] References Cited

U.S. PATENT DOCUMENTS

| | | | |
|---|---|---|---|
| 3,234,766 | 2/1966 | O'Brien | 70/282 X |
| 3,593,816 | 7/1971 | Kazaoka | 180/281 |
| 3,643,479 | 2/1972 | Solow | 70/281 X |
| 3,722,615 | 3/1973 | Okada et al. | 70/264 X |
| 3,765,502 | 10/1973 | Mark | 70/264 X |
| 3,779,332 | 12/1973 | Snitgen | 70/255 X |
| 3,785,187 | 1/1974 | Wolz | 70/264 |
| 3,877,266 | 4/1975 | McLaughlin | 70/280 |
| 4,137,985 | 2/1979 | Winchell | 70/237 X |
| 4,203,039 | 5/1980 | Pritchard | 361/160 X |
| 4,466,044 | 8/1984 | Fey | 70/237 X |
| 4,483,410 | 11/1984 | Fey | 180/281 |
| 4,537,049 | 8/1985 | Lupoli | 70/277 |

FOREIGN PATENT DOCUMENTS 3127732 7/1981 Fed. Rep. of Germany .

*Primary Examiner*—William M. Shoop, Jr.
*Assistant Examiner*—Shik Luen Paul Ip
*Attorney, Agent, or Firm*—Barnes & Thornburg

[57] ABSTRACT

This invention relates to a locking mechanism for the locks of the rear doors of a motor vehicle with one locking device for each door lock acting against the unauthorized opening of the doors from the interior side of the doors, a so called child safety lock. Each locking device is assigned an electric-motor-driven control unit, the rotational direction of said control unit being reversible via a double pole changing switch (double throw switch) and said control unit being connected with it and being able to be remotely operated with respect to locking or unlocking of the lock by a switching element that can be operated from the front seats. The locking condition of the locking device is indicated by an optical display.

To reduce manufacturing parts and expenses for the circuit controlling the optical display, this circuit is formed by parts of the circuit controlling the locking devices themselves. In certain embodiments the optical display is connected in series with a p-n-p transistor having its base and collector connected with respective grounded "off" lines of the locking device control circuits.

14 Claims, 2 Drawing Figures

REAR DOOR SAFETY LOCK ARRANGEMENT

BACKGROUND AND SUMMARY OF THE INVENTION

This invention relates to a locking mechanism or arrangement for locking passenger motor vehicle rear doors with locking devices preventing unauthorized unlocking of the doors from the interior of the vehicle. Such so-called child safety lock systems, which the present invention is directed at improving, are described in German Published Patent Application No. (DE-OS 3 127 732).

In order to make the awkward manual locking and unlocking unnecessary in the case of locking mechanisms—also known as so-called child safety locks—which each have a mechanically operable bolt on the front side of each rear door which is accessible only when the door is opened and, after it is in operation, prevents the unauthorized opening of the door from the interior side of the door, it has been comtemplated to carry out the operation from the front seats of the car and without opening the rear doors. In this case, a control unit driven by an electric motor is assigned to the locking mechanism of each door lock, said control being reversible in its rotational direction via a double pole changing switch and being connected with it and said control unit being remotely operable with respect to the locking or unlocking of the lock from a switching element that can be operated from the front seats. The locking condition of the locking mechanism may in this case be indicated by an optical display, in particularly by a luminous diode.

A use of such a construction which takes safety as well as comfort into account is connected with high costs because the expenditures that are required for checking whether the child safety lock is actually switched on are considerable because an electric switch has to be mounted at the corresponding door lock which, via a twin-core cable, switches the control light arranged in the area of the switching element as an "acknowledgement".

It is therefore an objective of the invention to develop a locking mechanism of the above type with a minimum use of electromechanical switching and circuit elements and expenditures in a more cost-effective manner than heretofore provided.

According to the invention, the above-noted objective is achieved by advantageously arranging the display mechanism in a portion of the circuit for controlling the locks so that it is not necessary to provide an additional switch in each door lock including the holding means and an additional circuit line.

In especially preferred embodiments, the display means is connected in series with a p-n-p transistor having its base and collector connected respectively to "off" lines of the locking device circuits.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
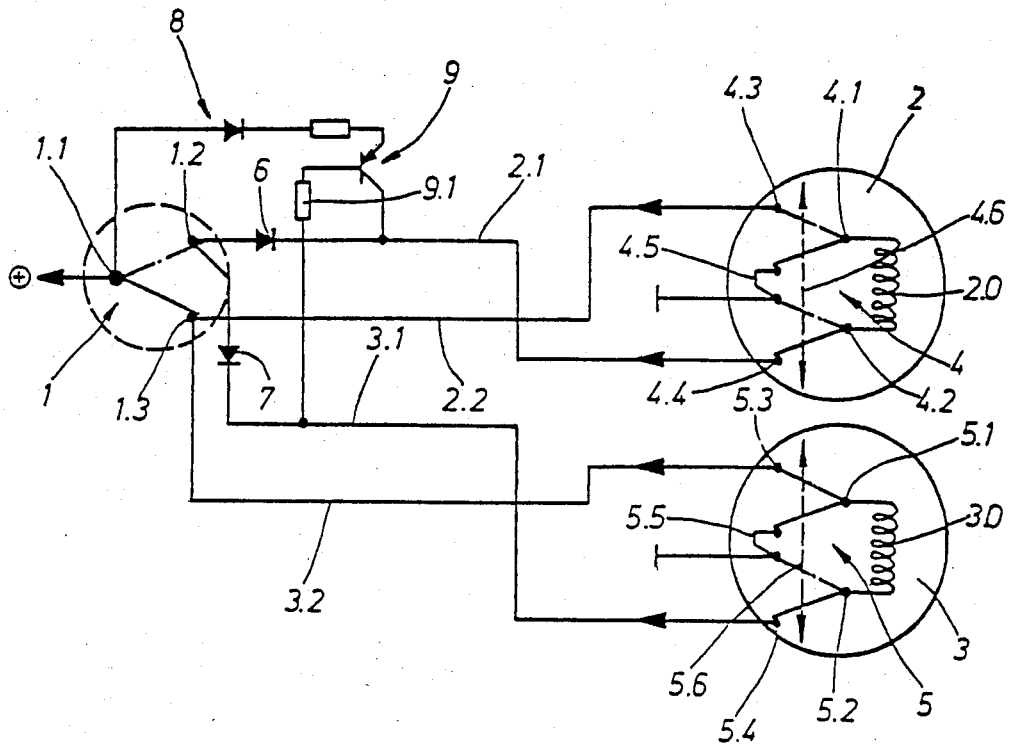
FIG. 1 is a basic wiring diagram of a safety door locking arrangement constructed according to a preferred embodiment of the invention.

In FIG. 1, a switching element 1 is shown which is preferably installed within the reach of the vehicle driver in the dashboard or in the center console. On the one hand, the switching element 1 has a movable contact 1.1, which is on the plus potential of the vehicle voltage system, and on the other hand, it has two fixed contacts 1.2 and 1.3, where at the fixed OFF contact 1.2, the OFF-lines 2.1 and 3.1 of the electric-motor-driven control units 2 and 3 which are separate from one another for the right and left rear door, are connected, while the ON switching lines 2.2 and 3.2 are connected to the fixed ON contact 1.3. Via the control units 2 and 3, the locking mechanisms (child safety locks) of the rear door locks are mechanically operated in a manner that is not shown in detail, as many such locks per se are known in the art, and the door locks are locked or unlocked.

A double pole or double throw changing switch 4 is installed into the control unit 2, and a double throw changing switch 5 is installed into the control unit 3, in which case the motor winding 2.0 of the control unit 2 is connected to the movable contact 4.1 and 4.2 of the double pole changing switch 4, and the motor winding 3.0 of the control unit 3 is connected to the movable contacts 5.1 and 5.2 of the double pole changing switch 5. The ON switching lines 2.2 and 3.2 are connected with the fixed contacts 4.3 and 5.3 of the double throw changing switches 4 and 5, while the OFF switching lines 2.1 and 3.1 are connected to the fixed contacts 4.4 and 5.4. An additional jointly switched fixed contact 4.5 and 5.5 of the double throw changing switches 4 and 5 is in each case connected to ground. Via a preferably mechanical functional connection 4.6 and 5.6, the double pole changing switch 4 is connected with the control unit 2 and the double pole changing switch 5 is connected with the control unit 3. For the separation of the two circuits, one diode 6 and 7 respectively is placed in the OFF switching lines 2.1 and 3.1. In addition, between the movable contact 1.1 of the switching element 1 located on the plus potential and the OFF switching line 2.1 of the control unit 2, a luminous diode 8 is switched in series with the emitter-collector line of a p-n-p transistor 9, the base of which via a resistor 9.1 is connected with the OFF switching line 3.1 of the other control unit 3.

The method of operation of the mechanism is as follows starting from an unlocked position of the door locks (the child safety lock is turned off). The movable contact 1.1 of the switching element 1 is connected to the fixed contact 1.2 and the movable contacts 4.1 and 4.2 of the double throw changing switch 4 are connected to the fixed contact 4.3 and at the grounding contact 4.5, and the movable contacts 5.1 and 5.2 of the double throw changing switch 5 are connected to the fixed contact 5.3 and at the grounding contact 5.5 (in FIG. 1, this switching condition is shown by the interrupted line showing the position of the movable contact).

When now, for the locking of the rear door locks, thus for the switching-on of the child safety lock, by means of the operation of the switching element 1, its movable contact 1.1 is switched from the fixed contact 1.2 to the fixed contact 1.3 to close a circuit (plus potential 1.1 - 1.3 - 2.2 - 4.3 - 4.1 - 2.0 - 4.2 - 4.5 - ground) for the operation of control unit 2, on the one hand, and, on the other hand, a circuit (plus potential - 1.1 - 1.3 - 3.2 - 5.3 - 5.1 - 3.0 - 5.2 - 5.5 - ground) for operation of the control unit 3. Thus the motor operators are activated to bring the locking mechanisms into a position which locks the doors. When the locked position (final position) is reached, the control unit 2, via the mechanical functional connection 4.6, switches the movable contact 4.1 from the fixed contact 4.3 to the ground 4.5, and the movable contact 4.2 from the ground contact 4.5 to the fixed contact 4.4. In the same way, the control unit 3, via the mechanical functional connection 5.6, switches the movable contact 5.1 from the fixed contact 5.3 to the ground contact 5.5, and the movable contact 5.2 is switched from the ground contact 5.5 to the fixed contact 5.4. As a result the motor operators of the control units are switched off and are simultaneously switched in such a way that when they are activated again, they run in reverse rotational direction.

Now, the OFF switching line 2.1 via 4.4 - 4.2 - 2.0 - 4.1 - 4.5 as well as the OFF switching line 3.1 via 5.4 -5.2 - 3.0 - 5.1 - 5.5 are connected to ground, thus controlling the transistor 9 and switching it to pass. The circuit for the control light 8 is thus closed, and its being on signalizes the locked condition of the door locks (child safety lock switched on). When only one control light is used according to the preferred illustrated embodiment, it is especially significant that the transistor 9 can only be controlled when both control units have actually switched and thus both OFF switching lines 2.1 and 3.1 are grounded. Therefore, when one control unit has not switched, there is no ground connection at one OFF switching line, and either the transistor cannot be controlled or the circuit for the control light cannot be closed.

Other embodiments are contemplated with separate control lights for each lock.

In order to protect the locking mechanism against an unauthorized or unintentional operation with respect to unlocking, a further development of the invention is especially advantageous in which an unlocking is only possible when, along with the operation of the switching element developed as a touch contact switch, a second switch or touch contact switch must be operated, for example, the door contact switch for the interior lighting which is closed when the front doors are opened.

If the motor vehicle is equipped with electrical window lifting means at the rear doors and has a switch by means of which the rear window lifting means can be secured against unauthorized use, the control element may also be secured via this switch.

Figure 2:
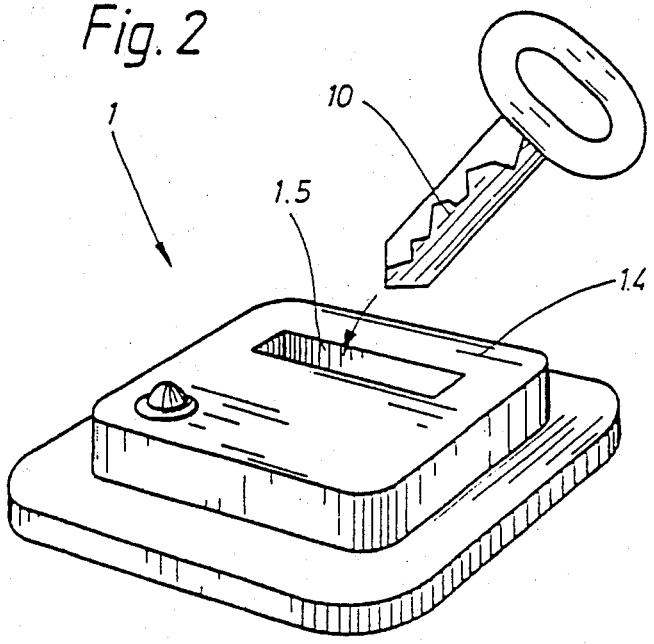
FIG. 2 schematically depicts a preferred embodiment of a switching element used to control the circuit of FIG. 1.

Further, in an especially preferred embodiment, the control element is developed as a press switch. It is developed in such a way that, for the unlocking, it can be switched from its ON to the OFF position only by releasing a safety lock. As shown in FIG. 2, the control element 1 developed as the press switch for this purpose has a pressure plate 1.4 having an opening 1.5. When the pressure plate 1.4 is pressed and thus the switching connection 1.1 - 1.3 is made, the pressure plate 1.4 in this pressed condition is stopped by means of a safety lock arranged in the switch, said safety lock only being able to be released again by means of the insertion of an object 10 (such as a pin or the ignition key) into the opening 1.5 provided for this purpose. After it has been unlocked, the pressure plate 1.4 then jumps back into its starting position, establishing the switching connection 1.1 - 1.2 and unlocking the locking devices. The specially preferred embodiment illustrated in FIG. 2 provides protection against the unauthorized actuation of the control element 1.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A safety and locking arrangement for preventing unauthorized interior unlocking of at least one vehicle door, comprising:

first switching means for alternately connecting a first voltage potential to a first or second conductive line;

first motor means, connected in series with a second voltage potential, for operating a door lock;

second switching means connected between said first and second conductive lines and said first motor means for connecting said first motor means by said first conductive line to said first switching means only when said door is unlocked, to activate said first motor means to lock the door in response to actuation of said first switching means, and for connecting said first motor means by said second conductive line to said first switching means only when said door is locked, to activate said motor means to unlock the door in response to actuation of said first switching means; and indicator means connected in parallel with said first switching means and between said first voltage potential and said second conductive line, for indicating when said door is locked and unlocked.

2. An arrangement according to claim 1, further comprising:

a second vehicle door;

second motor means, connected in series with said second voltage potential for operating a second door lock;

third and fourth conductive lines alternately connected by said first switching means to said first voltage potential;

third switching means connected between said third and fourth conductive lines and said second motor means for connecting said second motor means by said third conductive line to said first switching means only when said second vehicle door is unlocked, to activate said second motor means to lock the second vehicle door in response to actuation of said first switching means, and for connecting said motor means by said fourth conductive line to said first switching means only when said second vehicle is locked, to activate said second motor means to unlock the second vehicle door in response to actuation of said first switching means; and indicator means connected in parallel with said first switching means and between said first voltage potential and said fourth conductive line, for indicating when said doors are locked and unlocked.

3. An arrangement according to claim 2, wherein the indicator means includes optical display means.

4. An arrangement according to claim 3, wherein the first and second doors are rear doors of the vehicle, and wherein the optical display means is located in the front area of the vehicle spaced from the rear doors.

5. An arrangement according to claim 2, wherein said second switching means includes a first double throw switch means, having movable contacts connected to said first motor means and a pair of fixed contacts connected to said first and second conductive lines respectively, and a first set of further jointly switchable fixed contacts connected to said second voltage potential.

6. An arrangement according to claim 5, wherein said third switching means includes a second double throw switch means, having movable contacts connected to said second motor means, and a second pair of fixed contacts connected to said third and fourth conductive lines respectively, and a second set of further jointly switchable fixed contacts connected to said second voltage potential.

7. An arrangement according to claim 6, wherein said second and fourth conductive lines are both at said second voltage potential only when both said first and second vehicle doors are locked.

8. An arrangement according to claim 7, wherein said indicator means is connected to both said second and fourth conductive lines such that said indicator means will be actuated only when said second and fourth conductive lines are both at the second voltage potential.

9. An arrangement according to claim 8, wherein said first and second motors means are integrated together with said first and second double throw switches means into respective structural units.

10. An arrangement according to claim 9, wherein said indicator means includes a joint optical display which is connected in series with a P-N-P transistor, the collector of said transistor being connected with the second conductive line and the base of said transistor being connected with the fourth conductive line.

11. An arrangement according to claim 10, wherein the first switching means is formed as a press switch.

12. An arrangement according to claim 11, further comprising a safety lock which controls the press switch so that it can be switched from its on to its off position by release of the safety lock.

13. An arrangement according to claim 1, wherein said first switching means is formed as a press switch.

14. An arrangement according to claim 13, further comprising a safety lock which controls the press switch, so that it can only be switched from its on to its off position by release of the safety lock.

* * * * *